US006227442B1

(12) United States Patent
Evans, Jr.

(10) Patent No.: US 6,227,442 B1
(45) Date of Patent: May 8, 2001

(54) CONTAINER WITH INTEGRAL REINFORCING FLANGE

(75) Inventor: John A. Evans, Jr., Herminie, PA (US)

(73) Assignee: International Paper Company, Tuxedo, NY (US)

( * ) Notice: Subject to any disclaimer, the term of this patent is extended or adjusted under 35 U.S.C. 154(b) by 0 days.

(21) Appl. No.: 09/519,189

(22) Filed: Mar. 6, 2000

(51) Int. Cl.[7] ..... B65D 5/42

(52) U.S. Cl. ..... 229/122.31; 229/5.5; 229/122.27; 229/160; 229/168; 229/199

(58) Field of Search ..... 229/5.5, 122.27, 229/122.31, 125.35, 160, 167, 168, 199

(56) References Cited

U.S. PATENT DOCUMENTS 2,398,404 * 4/1946 Brooks ..... 229/125.35
2,450,110 * 9/1948 Brooks ..... 229/168
2,603,402 * 7/1952 Strauss ..... 229/167
2,733,852 * 2/1956 Williamson ..... 229/122.31
3,063,593 * 11/1962 Kuchenbecker ..... 229/122.27
3,073,500 * 1/1963 Goodrich et al. ..... 229/199
3,777,969 * 12/1973 Nurre ..... 229/168
3,831,836 * 8/1974 Ellison et al. ..... 229/199
3,945,558 * 3/1976 Elder ..... 229/122.27
4,042,164 * 8/1977 Croley ..... 229/122.27
4,105,153 * 8/1978 Locke ..... 229/122.27
4,266,715 * 5/1981 Garrison ..... 229/167

* cited by examiner

*Primary Examiner*—Gary E. Elkins
(74) *Attorney, Agent, or Firm*—Dennis H. Lambert

(57) ABSTRACT

A container for bulk materials, especially fluid materials, has integral reinforcing flanges on at least one of its top and bottom ends to resist bulging of the container side walls due to the pressure of the container contents. The flanges are tubular in transverse cross-section and are formed of a plurality of panels, with at least some of the panels having interfitting projections and recesses on adjacent ends thereof to interlock with one another and hold the flanges in erected condition. Corner posts may be inserted into the corners of the container, extending from the top to the bottom thereof, to reinforce the container for stacking of multiple containers on top of one another. The reinforcing flanges at the bottom end of the container have an upwardly and outwardly sloping support surface, and a tray insert having a marginal edge surface complementary to the support surface is supported on the support surface to form a bottom wall in the container.

19 Claims, 12 Drawing Sheets

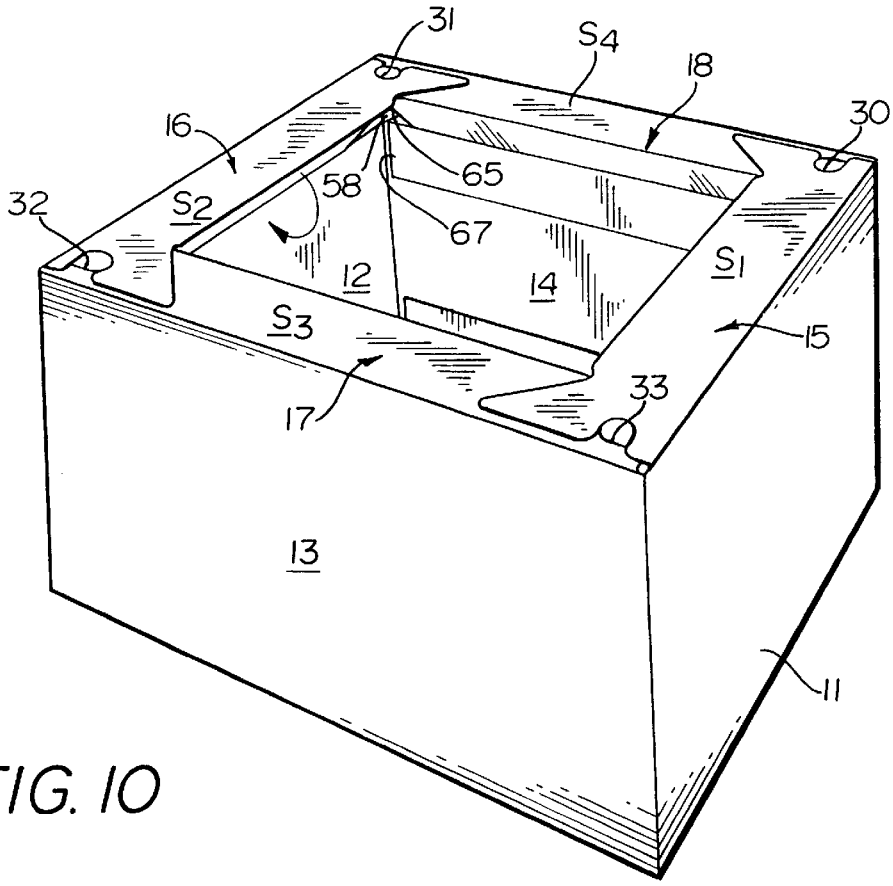
FIG. 10
FIG. 11
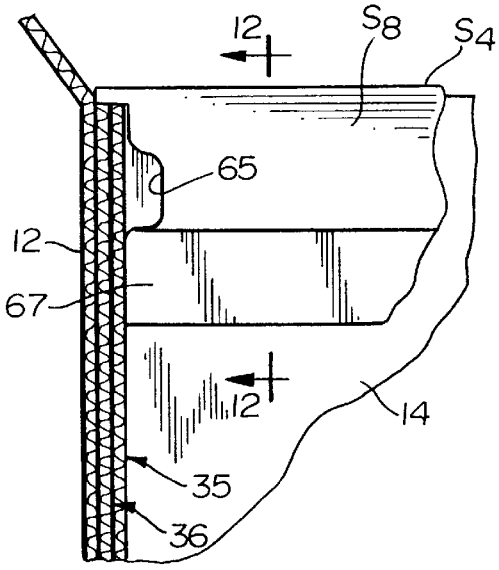
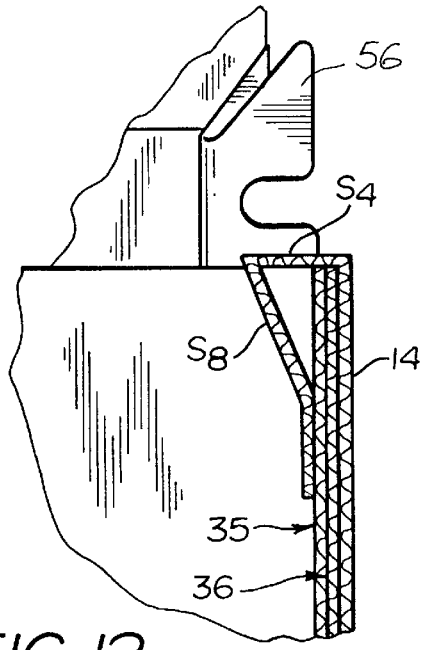
FIG. 12

CONTAINER WITH INTEGRAL REINFORCING FLANGE

BACKGROUND OF THE INVENTION

1. Field of the Invention

This invention relates to containers, and more particularly, to reinforced bulk material containers for storing and shipping fluid materials.

2. Prior Art

Containers for storing and shipping bulk quantities of materials are known in the prior art. These prior art containers include metal drums, plywood bins, metal frame constructions and fiberboard or cardboard boxes and drums. Containers for the bulk storage and shipment of fluid materials, in particular, commonly consist of metal drums because of their strength and durability. However, since these types of containers are relatively costly to produce, they are typically saved and reused, which is also at a relatively high cost, particularly in relation to the storage and shipment of the empty containers.

Although fiberboard and cardboard boxes and drums are generally less expensive to make, and some of them therefore may be economically disposed of after a single use, they may have less strength and durability than metal or plastic drums and similar "hard" containers. For instance, cardboard containers may not have sufficient "stacking" strength, and when the container is used for holding fluid material, there is a tendency for the container walls to bulge outwardly under the pressure of the contents. Accordingly, they are not used as often as otherwise may be desired in the storage and shipment of bulk materials, and especially fluid materials.

Efforts have been made in the prior art to develop stronger and more durable fiberboard and cardboard containers for the bulk storage and shipment of materials, including fluid materials. Examples of some prior art constructions are shown in U.S. Pat. Nos. 2,603,402, 3,294,306, 4,105,153, 4,341,338 and 4,623,075. U.S. Pat. Nos. 2,603,402 and 3,294,306, in particular, disclose cardboard containers having structure to improve stacking strength and/or bulge resistance. Note the rolled flanges at the top and bottom of the container in U.S. Pat. No. 2,603,402, and the interengaged flanges and corner posts in U.S. Pat. No. 3,294,306. The rolled flanges in the '402 patent have cuts that define mitered corners which frictionally interengage when the flanges are in their erected condition, and the flanges in the '306 patent have cuts which define openings that receive the corner posts when the container is in its erected condition. The mitered corners in the '402 patent do not interlock, but merely frictionally engage one another to retain them in their rolled condition, and there is no provision for receiving corner posts to improve stackability. The flat flanges in the '306 patent do appear to interlock with the corner posts inserted in the openings at the corners of the box, to retain the flanges and corner posts in position, but there does not appear to be any interlocking of the flanges in the absence of the corner posts, and the flat flanges would appear to provide only limited bulge resistance.

Accordingly, there exists a need for an economical bulk material container of cardboard or fiberboard construction having rolled flanges at least at one end of the container to resist bulging of the sidewalls, and corner posts to improve stackability, wherein the bulge resisting flanges have interlocking portions to retain them in position in either the presence or the absence of the corner posts.

SUMMARY OF THE INVENTION

In accordance with the present invention, an economical bulk material container of cardboard or fiberboard construction is provided, having integral, rolled reinforcing flanges at least at one end of the container to resist bulging of the sidewalls. Mutually interlocking portions are on adjacent flanges to retain them in their rolled, operative position, and corner posts may be provided to improve stackability. The flanges have openings to receive the corner posts and support them in their operative position, and the corner posts cooperate with the interlocking means to assist in retaining the flanges in their operative position.

More particularly, the container of the invention comprises a corrugated cardboard blank folded to define an enclosure having side walls and open ends, with integral flaps on the side walls at least at one of the ends folded to define rolled reinforcing flanges to resist bulging of the sidewalls under the pressure of the contents of the container. The flaps are divided by spaced parallel fold lines into a plurality of adjacent, side-by-side panels, with notches and tabs on the ends of adjacent flaps constructed to interlock with one another when the panels are folded about the fold lines into their erected configuration.

In that form of the invention disclosed herein, the flaps comprise a first or inner panel foldably joined to an adjacent side wall, a second or intermediate panel foldably joined to the inner panel, and a third or outer panel foldably joined to the intermediate panel.

The notches and tabs on the ends of the flaps are formed by a suitable method, e.g., by die-cutting, and are shaped so that when the panels are correctly folded about the fold lines, tabs project outwardly from the ends of one of the panels on one flange and extend into interlocking relationship in notches in an end of a panel of an adjacent flange. Portions of other panels on adjacent flanges abut one another to assist in retaining the panels in their interlocked relationship.

When erected, the panels form a rolled tubular flange having a triangular transverse cross-sectional shape, with the first or inner panel defining a flat surface substantially coplanar with the end of the container and facing outwardly thereof, and the second or intermediate panel defining an inclined surface extending inwardly of the container and toward the adjacent side wall from an inner marginal edge of the flat surface. The third or outer panels in the flanges on a first pair of opposed side walls of the container are folded toward the opposite end of the container to lie flat against the adjacent side wall when the flange is erected, and the outer panels in the flanges on a second pair of opposed side walls are folded inwardly behind the inclined intermediate panel to lie behind the flange flat against the adjacent side wall of the container.

While this triangular configuration provides bulge resistance with minimal encroachment into the interior space of the container, it is to be understood that a different number of panels could be provided to form flanges with other cross-sectional configurations, e.g., square or rectangular, without departing from the spirit and scope of the invention.

One or more tubular liner sleeves may be placed in the container to reinforce the side walls, if desired. These sleeves can be laminated together and to the side walls, or may be simply formed into a tube and inserted into the container.

In a preferred construction, rolled reinforcing flanges are formed on both ends of the container, with the flanges on the bottom end of the container defining a peripheral, interior, downwardly and inwardly inclined surface.

A shallow tray insert with an upwardly and outwardly inclined peripheral wall is inserted into the container to rest at its periphery on the inclined surface of the flange at the bottom of the container. This tray insert provides a bottom in the container, and performs the function that would otherwise have been provided by the flanges on the bottom of the container if they had not been folded to create the reinforcing flange.

In a further preferred construction, cut-outs are provided in the ends of the panels to form generally circular openings at the corners of the container when the flanges are erected, extending completely through the top flanges but only partially through the bottom flanges. Corner posts can then be inserted through the openings in the top flanges and into the openings in the bottom flanges to provide improved stacking strength. Engagement of the corner posts in the openings serves to hold the corner posts in position, and also serves to help hold the flanges in their interlocked folded relationship.

A flexible bag can be placed in the container in accordance with known technology to hold liquid materials such as, e.g., fruit juices, pastes, purees and other liquid food products, adhesives, and other materials. A die cut opening can be provided near the bottom of the container for accommodating a valve or spout when liquid products are placed in the container.

Although the container shown in the drawings is rectangular in cross-section, the principles of the invention could be applied to a container having other shapes, e.g., octagonal. Moreover, if the container is made of corrugated cardboard, the corrugations could run or extend vertically in the side walls, thereby increasing the stacking strength of the container.

BRIEF DESCRIPTION OF THE DRAWINGS

The foregoing as well as other objects and advantages of the invention will become apparent from the following detailed description when considered in conjunction with the accompanying drawings, wherein like reference characters designate like parts throughout the several views, and wherein:

FIG. 10 is a top perspective view similar to FIG. 9, showing the outer and intermediate panels of the second pair of flaps folded downwardly into the container so that the tabs on opposite ends thereof slide past the first pair of folded flanges to engage in notches formed in the ends of the first pair of flanges, thereby holding the flanges in the erected condition, and showing the openings at the corners for supporting the corner posts;

FIG. 11 is an enlarged fragmentary sectional view taken along line 11—11 in FIG. 8;

FIG. 12 is an enlarged fragmentary sectional view taken along line 12—12 in FIG. 11;

DETAILED DESCRIPTION OF THE PREFERRED EMBODIMENTS

Figure 1:
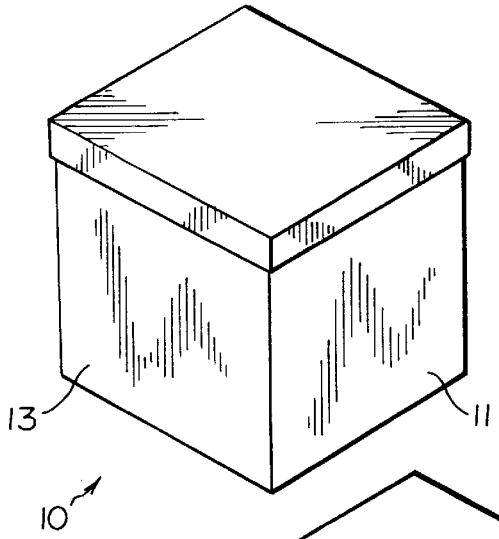
FIG. 1 is a top perspective view of a container in accordance with the invention, showing a lid or cover in place on the open top end of the container.
Figure 2:
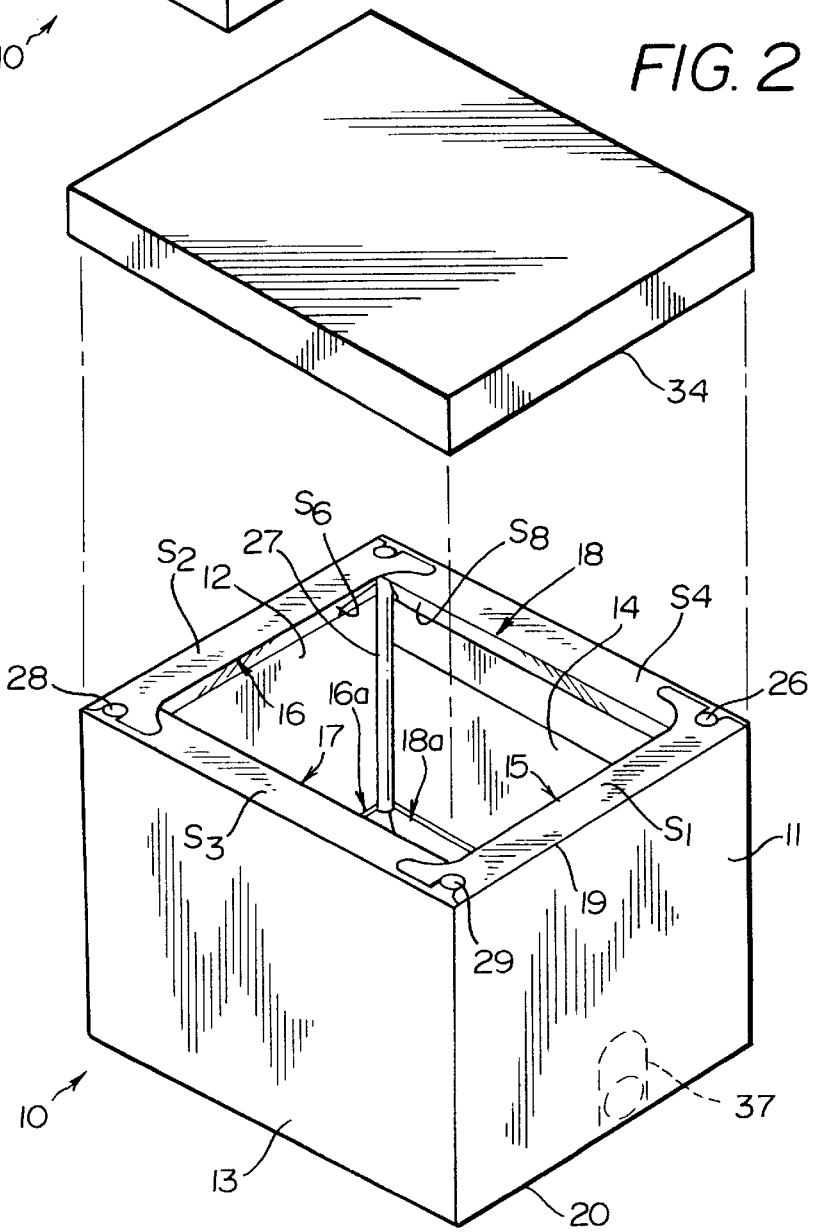
FIG. 2 is an exploded top perspective view of the container of the invention, showing the lid or cover removed.
Figure 3:
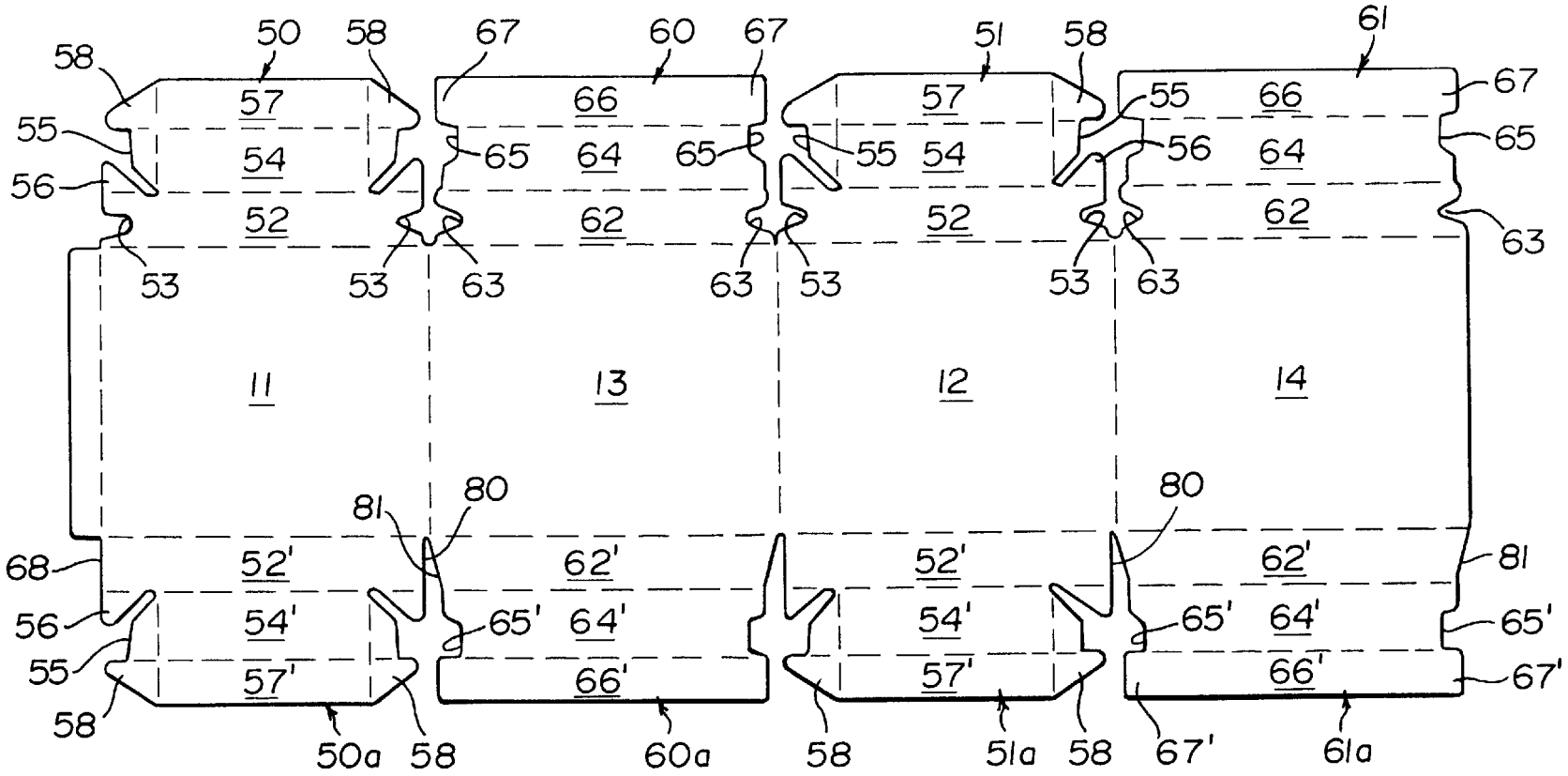
FIG. 3 is a plan view of the blank used to form the container side walls and flanges of the invention.
Figure 4A:
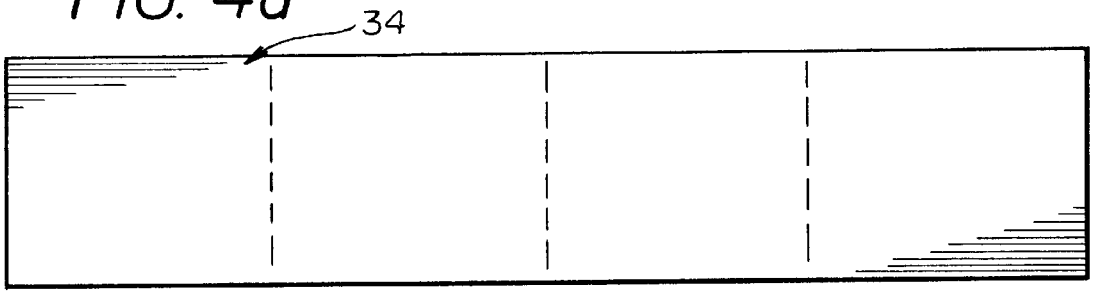
FIGS. 4*a* and 4*b* are plan views of blanks used to form the tubular liner sleeves that may be placed in the container.
Figure 4B:
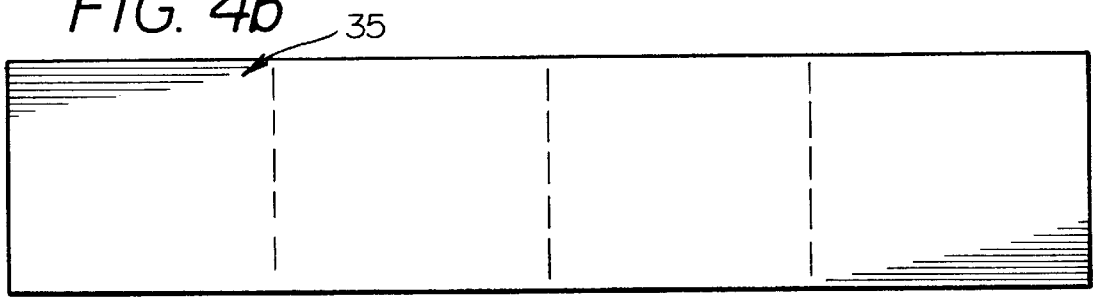
Figure 5:
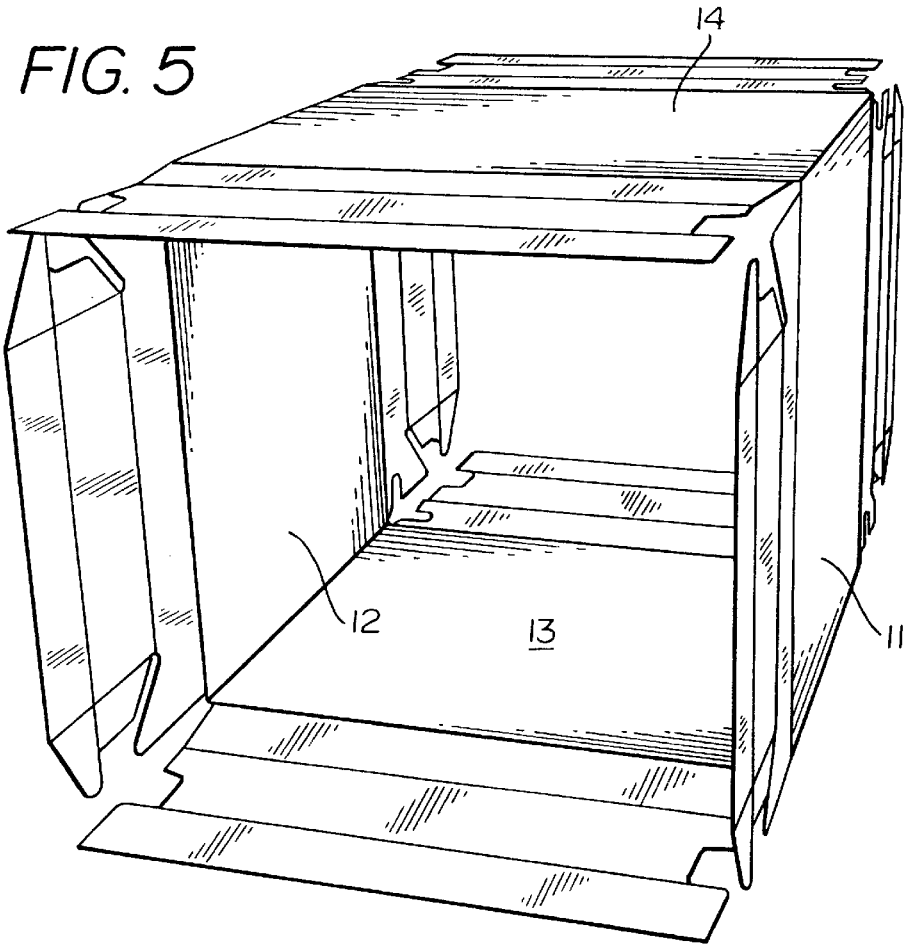
FIG. 5 is a perspective view of a partially erected container according to the invention, shown lying on its side with the side walls erected and the end flaps in their unfolded state.
Figure 13:
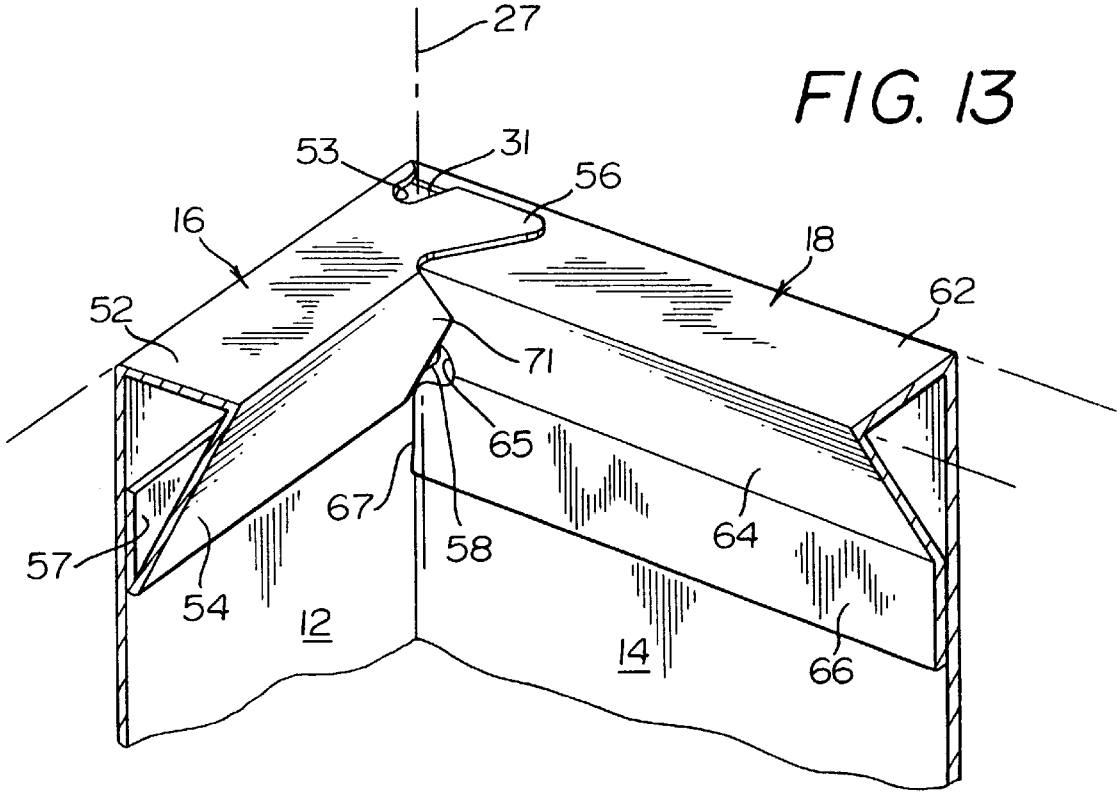
FIGS. 13 and 14 are enlarged fragmentary top perspective views of inside corners of the upper end of the container, showing how the tabs and notches on the opposite ends of the flanges on adjacent sides of the container interengage to hold the flanges in their erected condition, and also showing the openings for receiving the corner posts.
Figure 14:
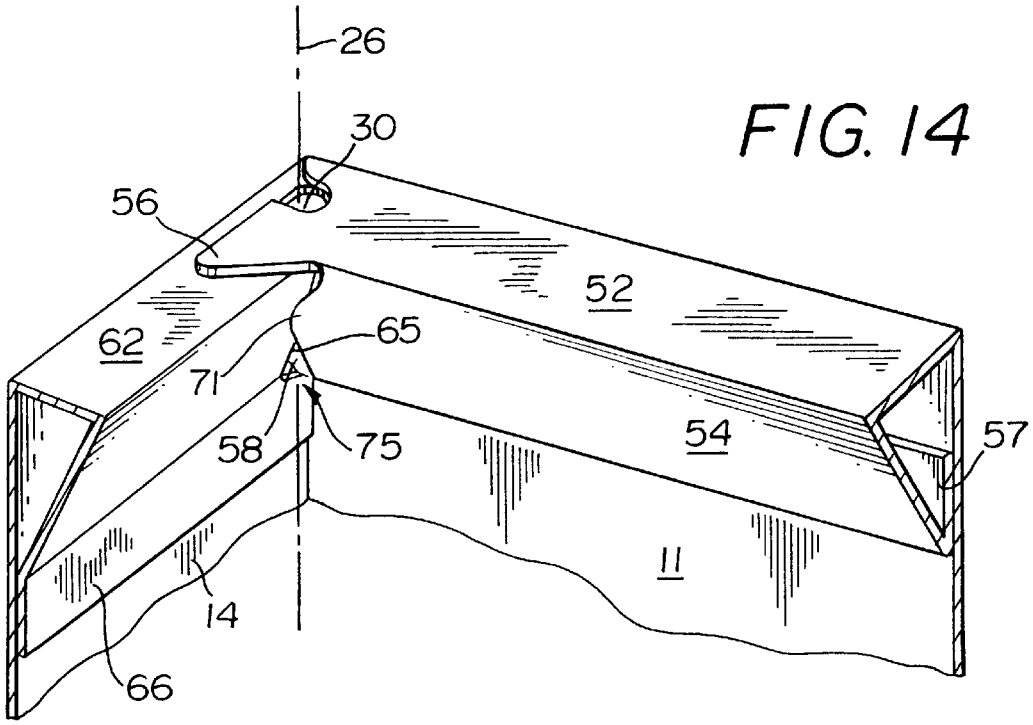
Figure 15:
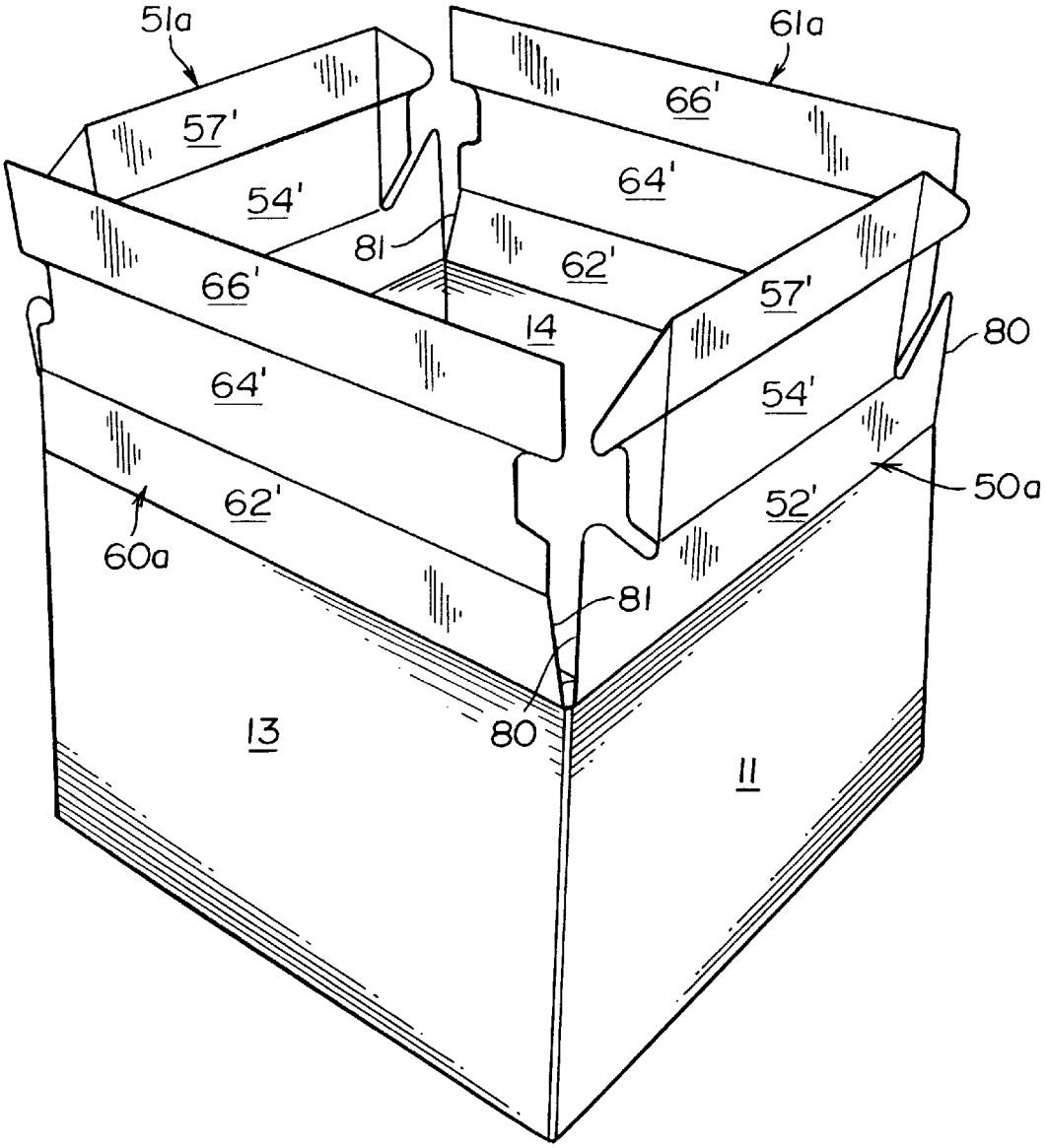
FIG. 15 is a top perspective view similar to FIG. 6, but oriented with the bottom end of the container uppermost and showing the flaps on the bottom end of the container in their unfolded condition.
Figure 17:
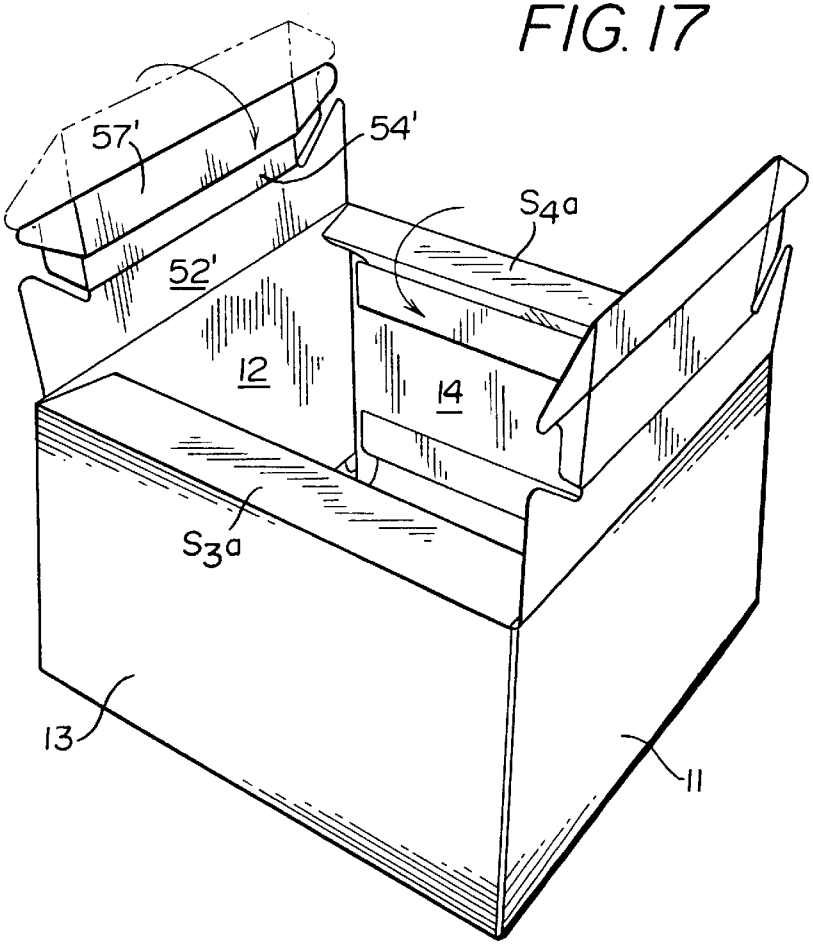
FIGS. 16 through 19 are views corresponding to FIGS. 7–10, but of the bottom end of the container, and showing the absence of openings in the corners.
Figure 16:
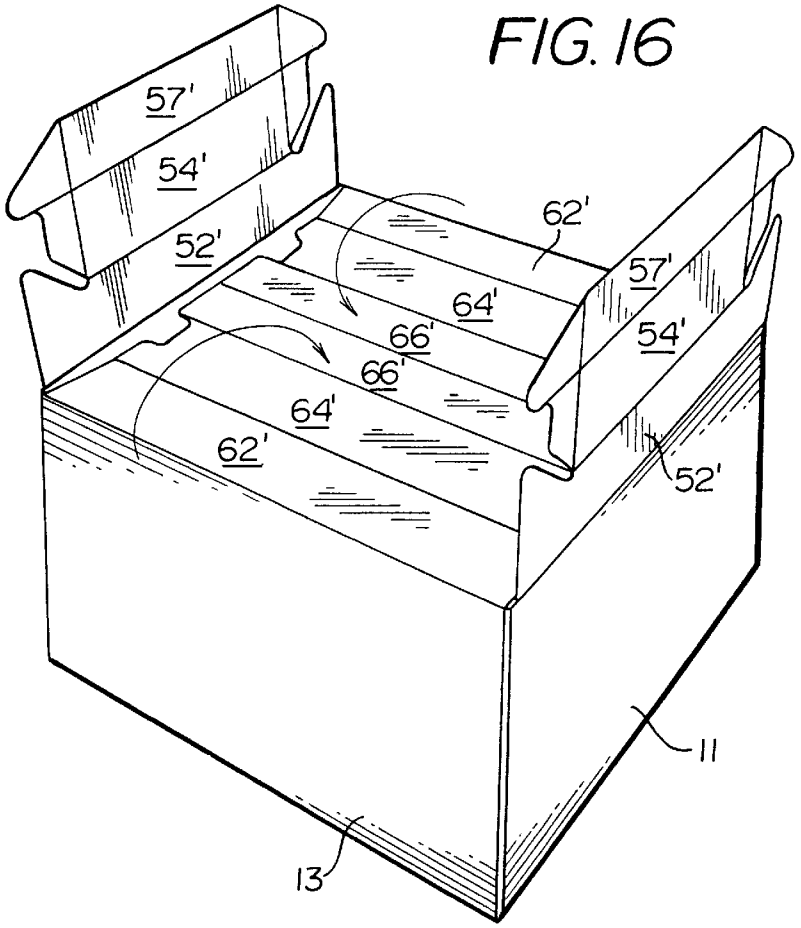
Figure 19:
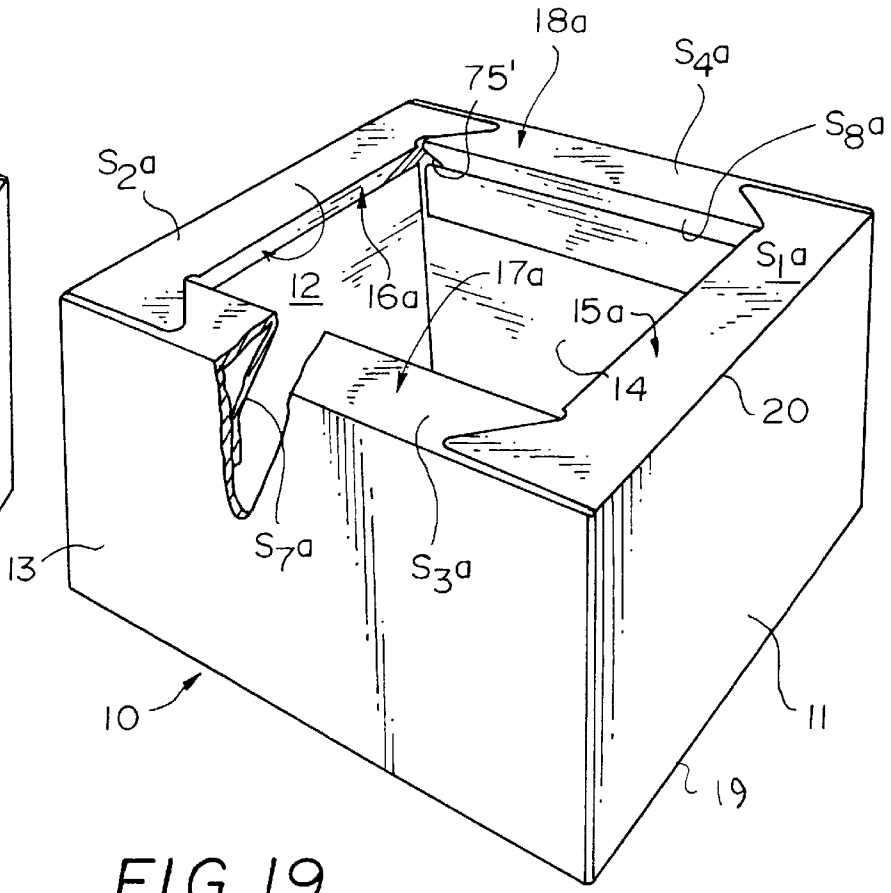
Figure 18:
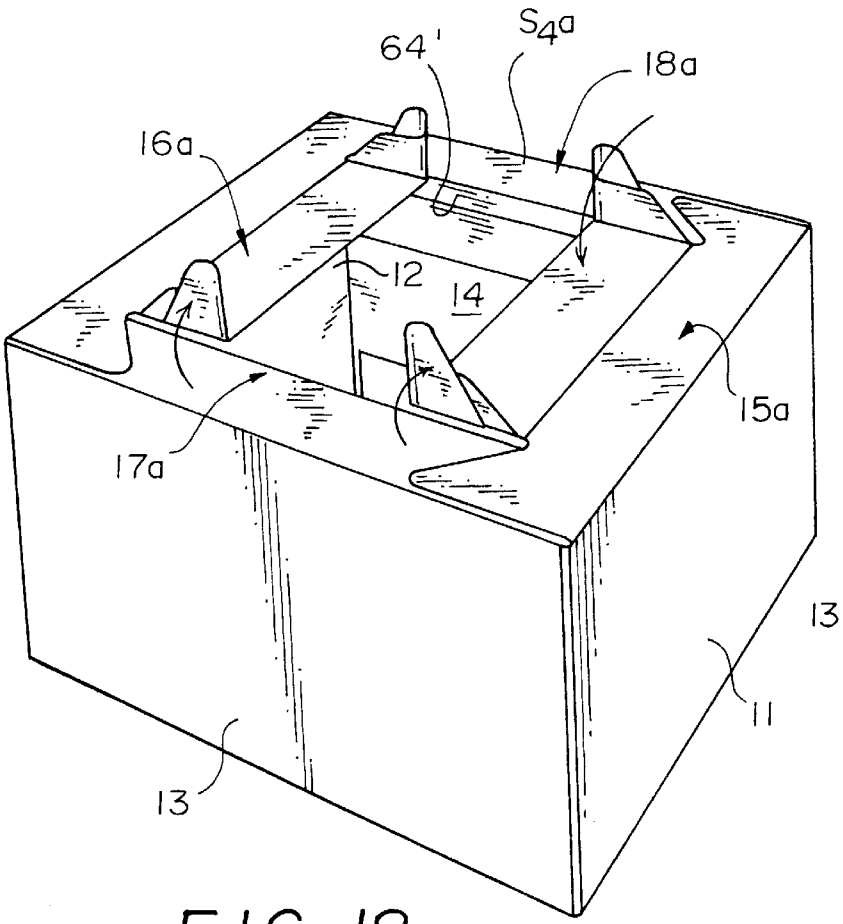
Figure 21:
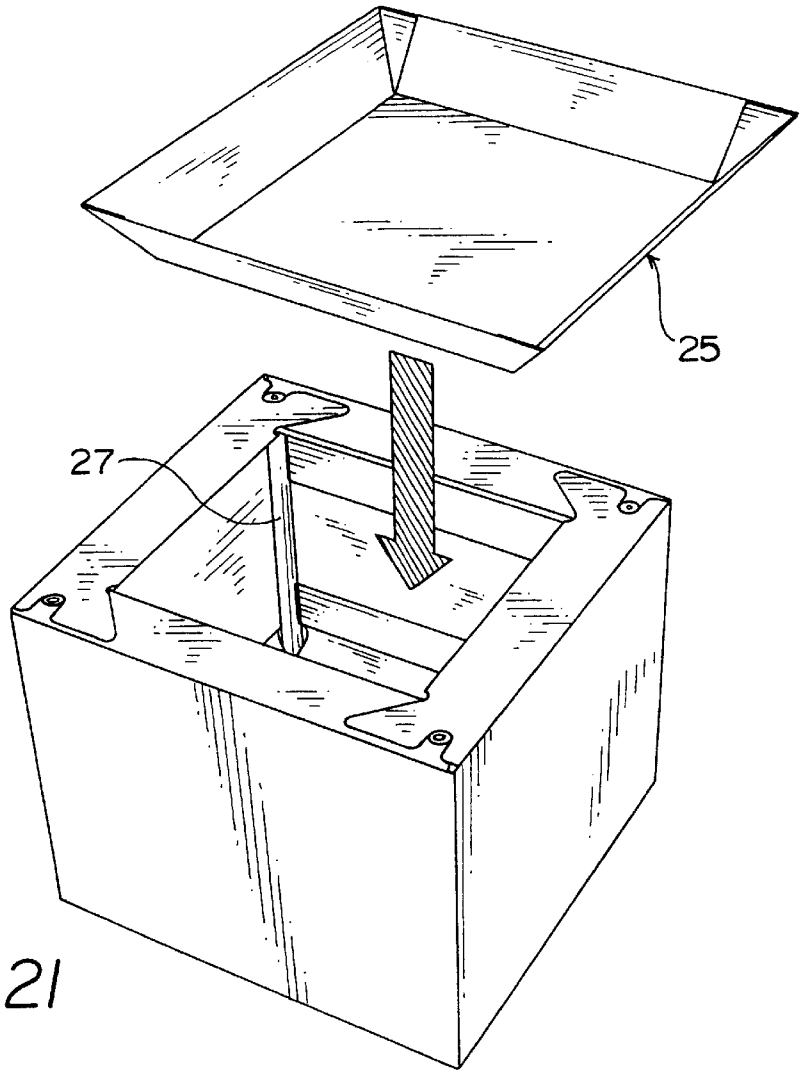
FIG. 21 is an exploded top perspective view of the container, with corner posts installed, and showing a bottom tray insert about to be installed in the container.
Figure 20:
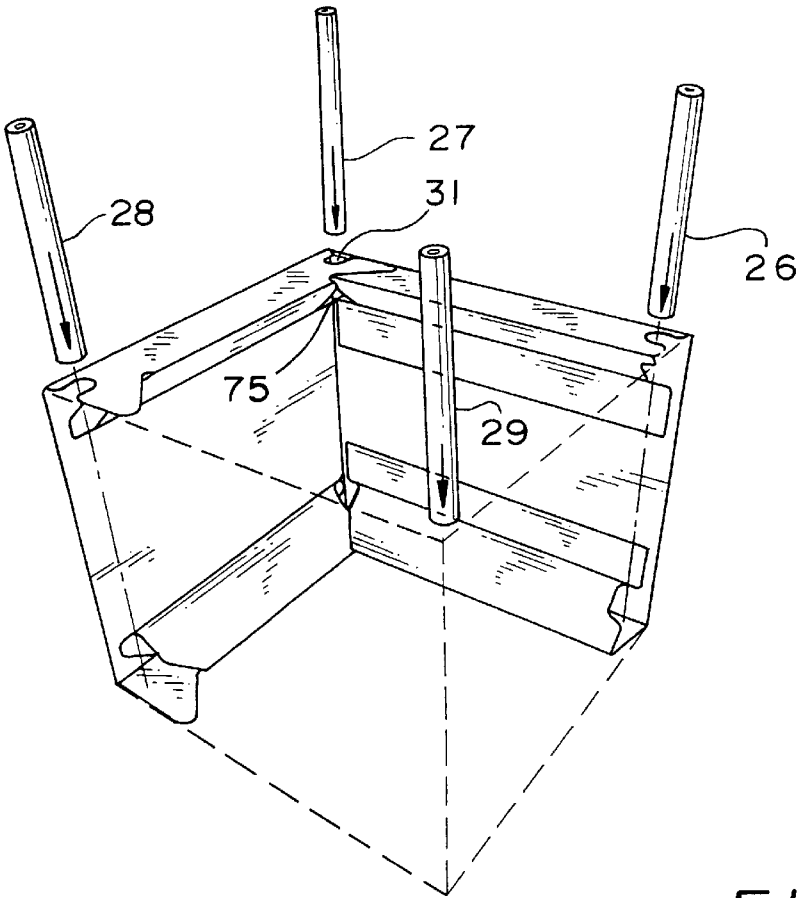
FIG. 20 is a somewhat schematic top perspective view of the container, with portions broken away, showing how the corner posts are inserted into the openings formed at the corners of the container in adjoining ends of the flanges.
Figure 22:
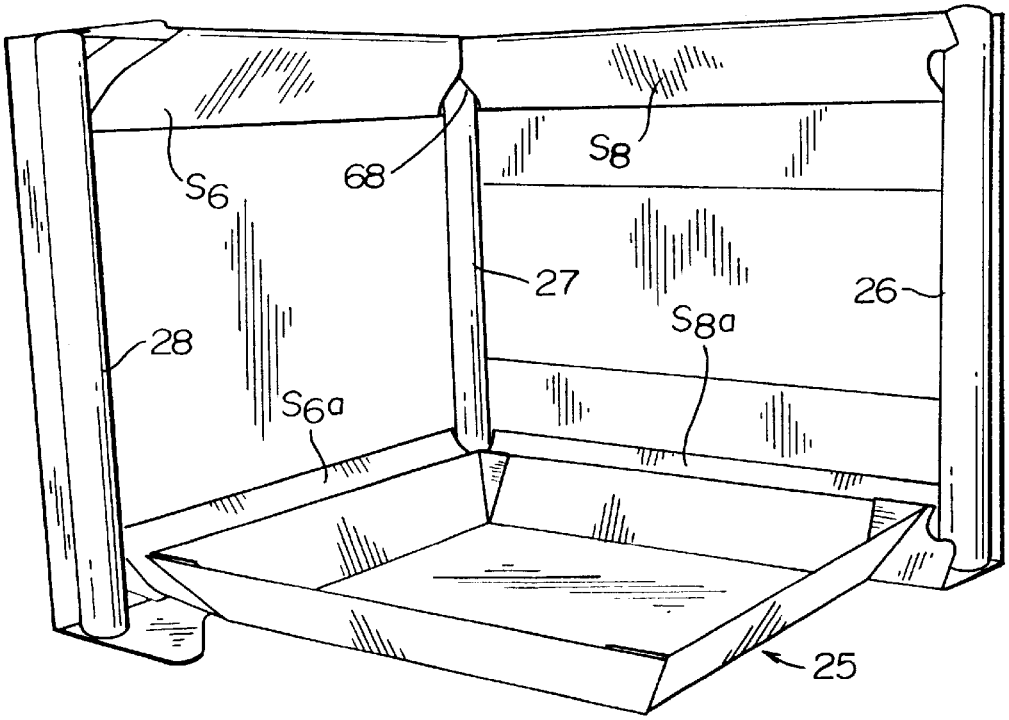
FIG. 22 is a schematic perspective view of the container, with portions broken away, depicting the container with corner posts and bottom tray insert installed.
Figure 23:
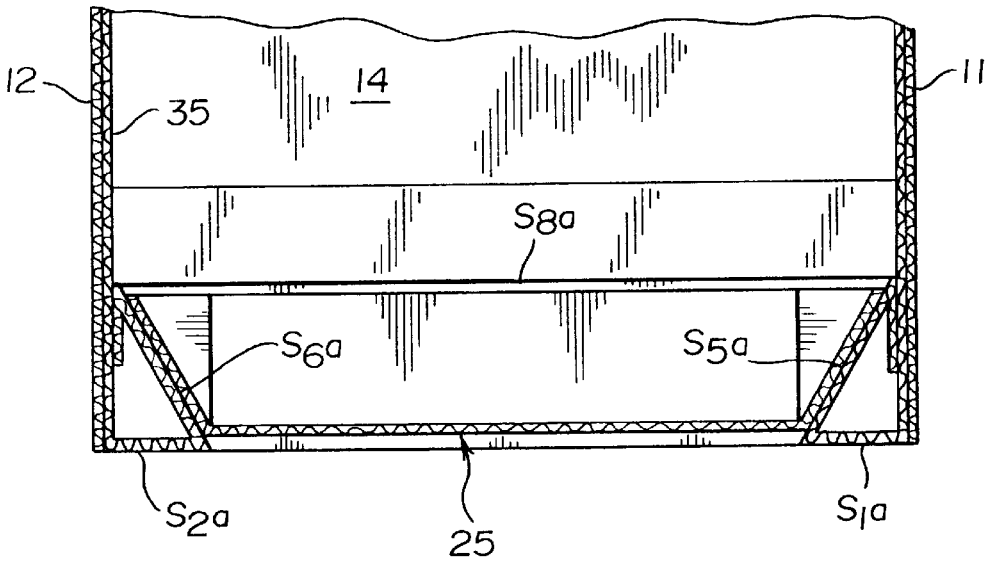
FIG. 23 is a fragmentary transverse sectional view of a bottom end portion of the container, with the corner posts omitted, showing how the bottom tray insert rests on the inclined surfaces formed by the rolled flanges at the bottom of the container.

Referring more particularly to the drawings, a container in accordance with the invention is indicated generally at 10 in the drawings. In the embodiment illustrated and described herein, the container has a rectangular configuration with first and second pairs of opposed side walls 11, 12 and 13, 14, respectively. First and second pairs of rolled reinforcing flanges 15, 16 and 17, 18 are integrally formed on the first and second pairs of opposed side walls, respectively, at the top end 19 of the container (see, e.g., FIGS. 2, 10 and 13), and corresponding pairs of rolled reinforcing flanges 15*a*, 16*a* and 17*a*, 18*a* are preferably formed on the bottom end 20 (see, e.g., FIGS. 2, 18 and 19).

In the particular embodiment of the invention illustrated and described herein, the reinforcing flanges are triangularly shaped in transverse cross-section. The flanges at the top end of the container respectively present surfaces $S_1$, $S_2$, $S_3$ and $S_4$ that are essentially coplanar with one another and with the top end of the container, and surfaces $S_5$, $S_6$, $S_7$ and $S_8$ that extend downwardly and outwardly from inner marginal edges of the surfaces $S_1$, $S_2$, $S_3$ and $S_4$ to an adjacent side wall.

The flanges at the bottom end of the container similarly present corresponding outer surfaces $S_1$a, $S_2$a, $S_3$a and $S_4$a that are essentially coplanar with one another and with the bottom end of the container, and surfaces $S_5$a, $S_6$a, $S_7$a and $S_8$a that extend upwardly and outwardly from inner marginal edges of the surfaces $S_1$a, $S_2$a, $S_3$a and $S_4$a to an adjacent side wall.

The surfaces $S_5$a, $S_6$a, $S_7$a and $S_8$a define an upwardly and outwardly angled annular support surface surrounding the open bottom end of the container, on which a tray-shaped bottom insert 25 may be supported (see FIGS. 20–23).

Corner posts 26, 27, 28 and 29 are preferably inserted through openings 30, 31, 32 and 33 (see FIGS. 10, 13, 14 and 20–22) formed through the top flanges 15–18 at the top corners of the container to reinforce the container for improved vertical stacking of multiple containers, and a cover 34 may be provided to close the open top.

Although not essential to the invention, one or more liner sleeves 35, 36, shaped complementally to the shape of the container side walls, may be inserted into the container to provide additional strength. See FIGS. 4*a*, 4*b*, 11, 12 and 23.

Further, a flexible bag or liner (not shown) may be placed in the container to hold liquid products such as fruit juices, pastes, purees and other liquid food products, adhesives, and the like. A die cut opening 37 (FIG. 2) may be provided near a bottom end of one of the side walls to accommodate a valve or spout (not shown) to remove product.

Further details of construction and assembly of the flanges 15, 16, 17 and 18 at the top of the container can be seen best with reference to FIGS. 3 and 6–14. The first pair of opposed side walls 11 and 12 have identically shaped flaps 50 and 51, respectively, on their upper ends, each comprised of a first or inner panel 52 having a rounded notch or cutout 53 in each of its opposite ends, a second or intermediate panel 54 having an irregularly shaped cutout 55 in each of its opposite ends, defining a laterally projecting tab 56, and a third or outer panel 57 having a generally triangularly shaped flap 58 on each of its opposite ends.

The second pair of opposed side walls 13 and 14 also have identically shaped flaps 60 and 61, respectively, on their upper ends, each comprised of a first or intermediate panel 62 having a rounded notch or cutout 63 in each of its opposite ends, a second or intermediate panel 64 having a slightly rounded rectangular cutout 65 in each of its opposite ends, and a third or outer panel 66 having a generally rectangularly shaped flap 67 on each of its opposite ends.

Figure 7:
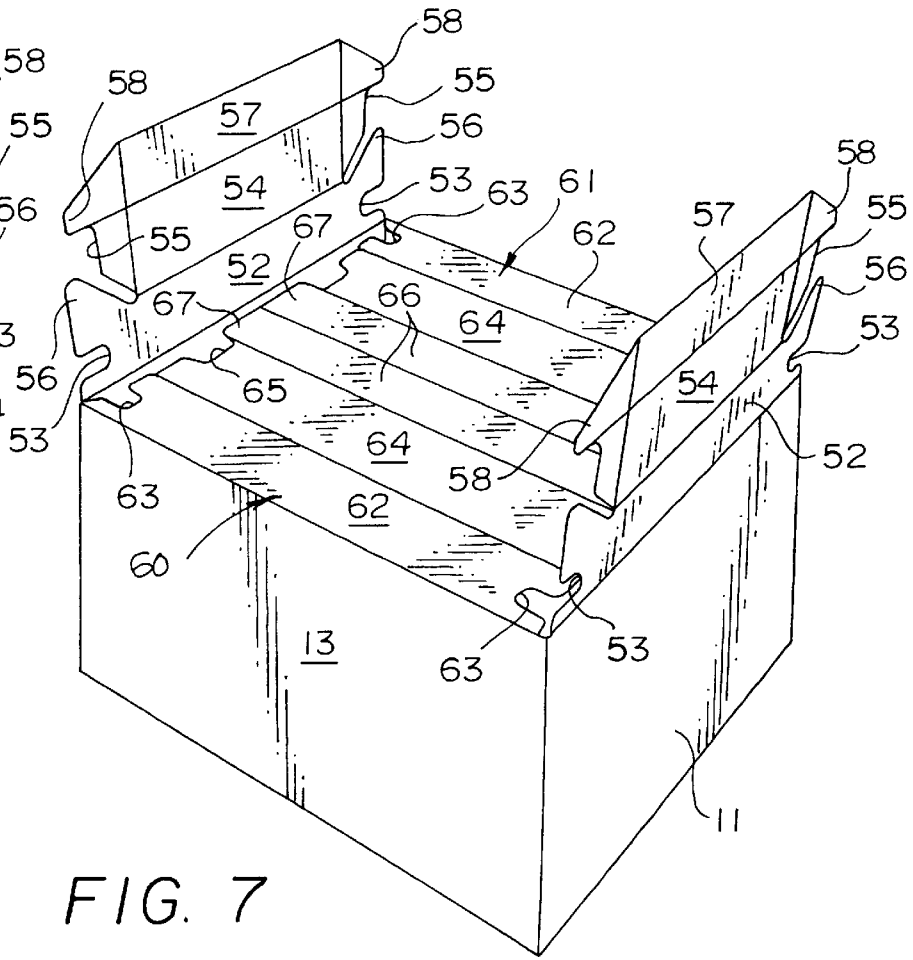
FIG. 7 is a top perspective view similar to FIG. 6, showing a first pair of flaps on opposed side walls folded inwardly into generally coplanar relationship over the end of the container.
Figure 6:
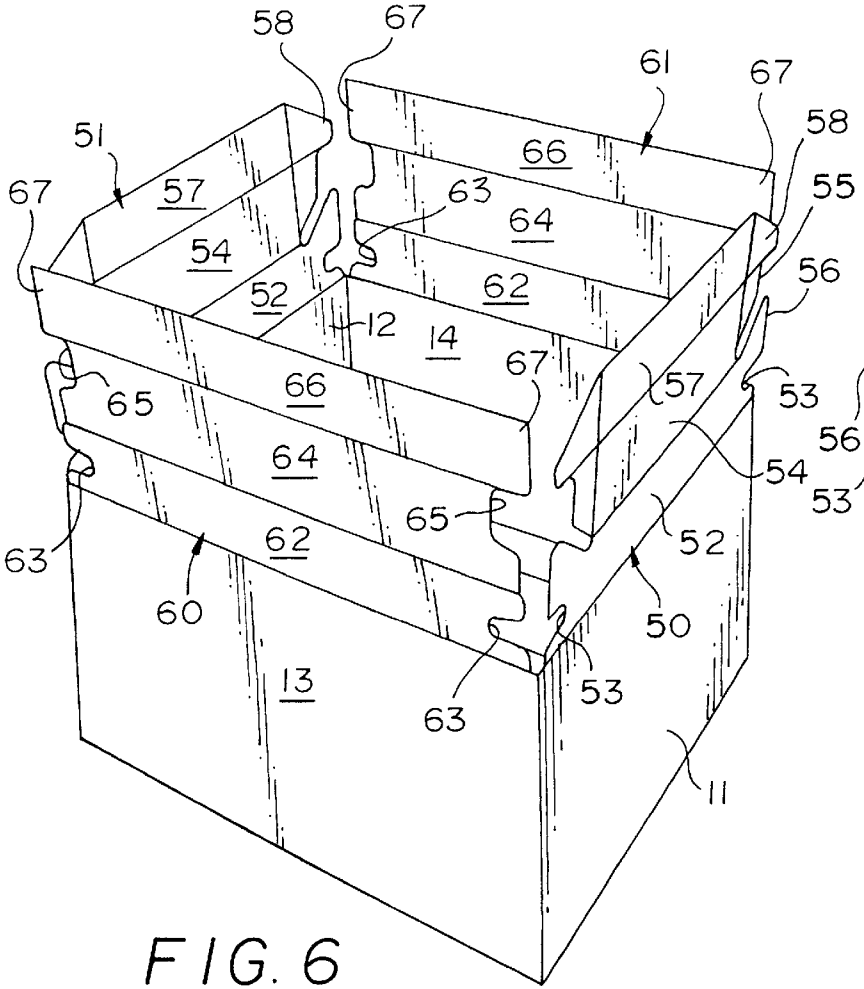
FIG. 6 is a top perspective view of a container according to the invention, shown in upright position with the flaps at the top end of the box projecting axially outwardly from the box in their unfolded state.
Figure 8:
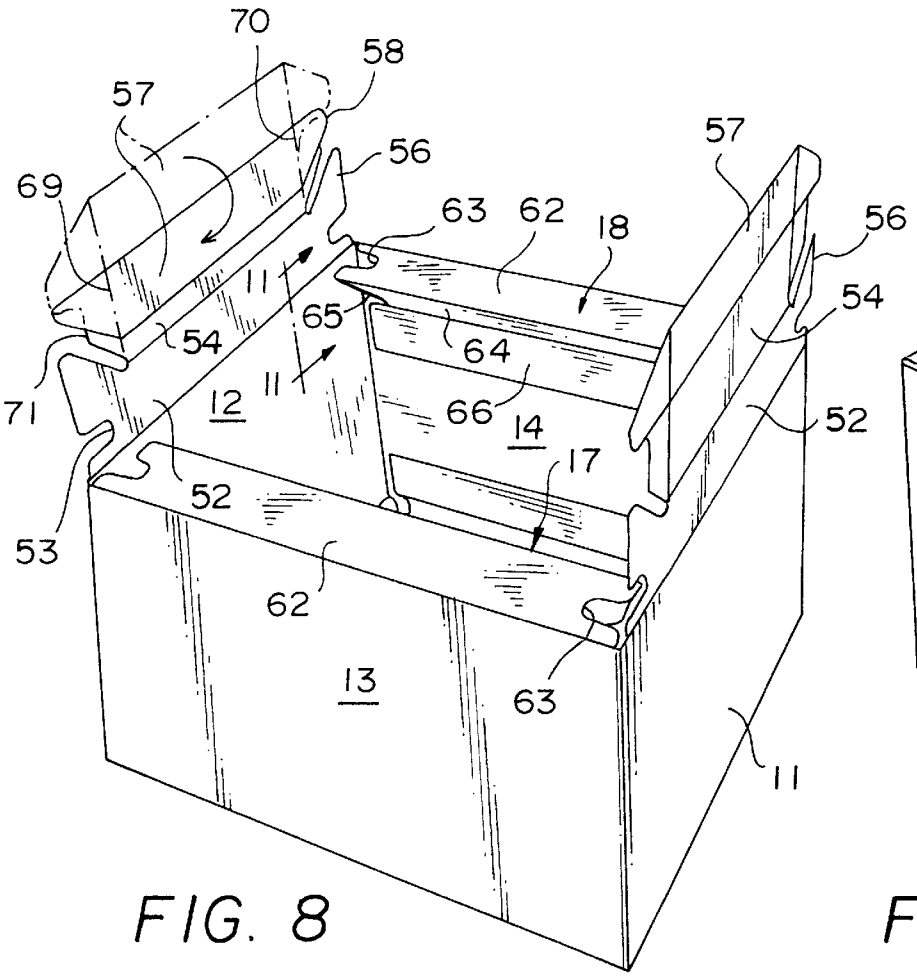
FIG. 8 is a top perspective view similar to FIG. 7, showing the panels of the first pair of flaps folded so that the first or inner panel of the respective flaps lies generally in the plane of the open end of the container, the second or intermediate panel extends angularly downwardly and outwardly toward the adjacent side wall, and the third or outer panel extends parallel to and lies substantially flat against the adjacent side wall, and also showing the third or outer panel of one of a second pair of flaps on opposed side walls folded inwardly to lie against the intermediate panel of that flap.

To erect the flanges formed by flaps 50, 51 and 60, 61, and with particular reference to FIGS. 6–14, the flaps 60 and 61 are first folded inwardly over the open end of the container, as shown in FIG. 7. The intermediate panels 64 are then folded inwardly and downwardly about the score lines separating them from panels 62, so that the panels 64 extend angularly outwardly and downwardly to the respective adjacent side walls, with panels 62 lying substantially coplanar with the end of the container, and panels 66 extending downwardly from the lower edges of panels 64 and lying against the respective side walls, as shown in FIG. 8, to form the tubular flanges 17 and 18.

Figure 9:
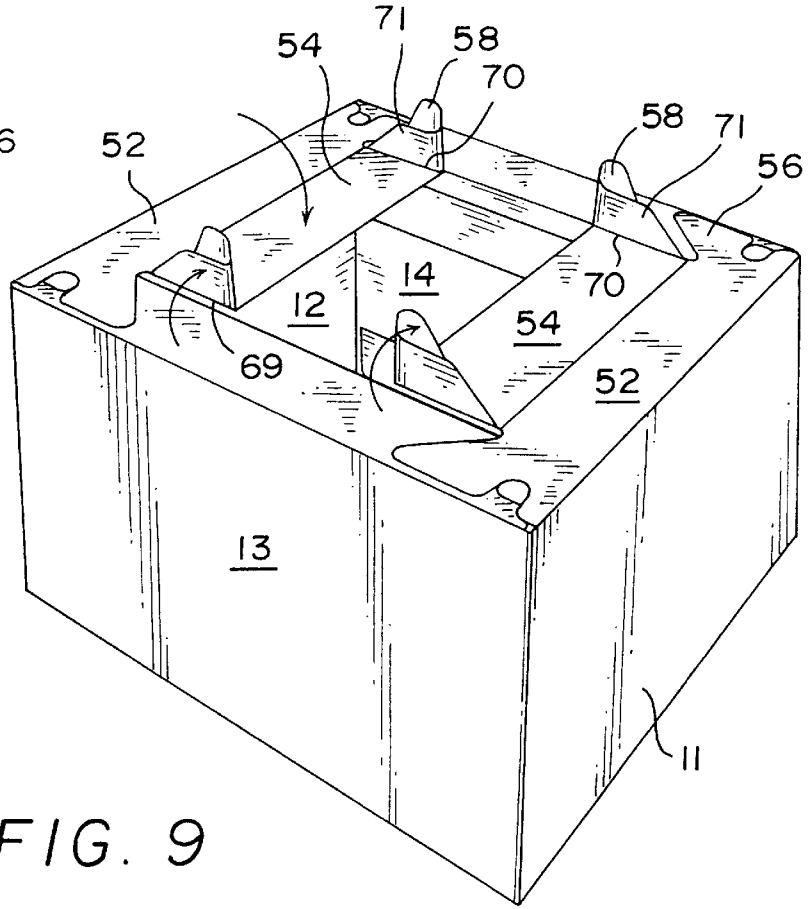
FIG. 9 is a top perspective view similar to FIG. 8, showing the panels of the second pair of flaps folded so that the third or outer panel is first folded over to lie against an inner surface of the second or intermediate panel, and the flap is then folded inwardly over the end of the box so that the first or inner panel and the intermediate panel are substantially coplanar with the end of the container, with the third panel lying beneath the intermediate panel, and with the tabs at opposite ends of the outer and intermediate panels folded upwardly away from the plane of the end of the container.

The outer panels 57 of flaps 50 and 51 are next folded inwardly about the score lines separating these panels from intermediate panels 54, so that the panels 57 lie against the inside surface of panels 54, as shown in FIG. 8. The flaps 50 and 51 are then folded downwardly about the score lines joining them to the adjacent side walls, so that the flaps lie substantially coplanar with the end of the container, and the opposite ends of panels 54 and 57 are bent upwardly about score lines 69 and 70, as shown in FIG. 9. Panels 54 and 57 are then pressed downwardly past the folded flanges 17 and 18, whereby the flaps 58 on panels 57 slide past angled panels 64 and "snap" into the cutouts 65 on panels 64. It will be noted that with the panels thus folded, and the flaps 58 engaged in cutouts 65, a shoulder 71 is formed on the ends of panels 54, and this shoulder engages against the panel 64. The engagement of flap 58 in cutout 65 and the engagement of shoulder 71 against panel 64 securely interlocks the panels in their folded condition, as shown in FIG. 10, to form the tubular flanges 15 and 16.

Additionally, with the flanges folded as described above, the notches 53 and 63 on adjacent panel ends are in registry with one another to form the rounded openings 30–33 in the corners of the container, and the cutouts or notches 55 and 65 in panels 54 and 64, respectively, are in registry with one another to form openings 75 (see, e.g., FIGS. 14 and 20) between the adjacent ends of the flanges and in alignment with the openings 30–33.

With particular reference to FIGS. 3 and 15–19, where the container is shown inverted, with its bottom side uppermost, flaps 50*a*, 51*a* and 60*a*, 61*a* substantially identical to those on the top end of the container are formed on the bottom ends of the side walls 11, 12 and 13, 14, respectively, except that the first or inner panels 52' and 62' do not have rounded cutouts or notches in their opposite ends. Instead, the opposite ends 80 of the panels 52' extend substantially collinear with the opposite edges of the associated side walls, and the opposite ends 81 of the panels 62' are slightly inwardly inclined relative to the side edges of the associated side panels. The result of this is that when the panels 52', 54', 57' and 62', 64', 66' are folded as shown in FIGS. 15–19, and substantially identically as described in connection with the panels at the top end of the container, an inner opening 75' (see FIGS. 19 and 20) is formed between adjacent ends of the angled panels 54' and 64', but no opening exists through the overlapping adjacent ends of panels 52', 62'. Thus, when the container is in an upright position and corner posts 26–29 are inserted through the openings 30–33, the lower ends of the corner posts will rest on the overlapping adjacent ends of panels 52' and 62'.

In addition to the fact that the openings in the flanges at the top and bottom ends of the container serve to hold the corner posts in position, it should be noted that the corner posts also function to help retain the flanges in their folded positions. That is, when the posts are inserted through the respective aligned openings in the flanges, they extend inwardly of and against the flaps 58 and the panel ends 67 (see, e.g., FIGS. 13 and 14), holding them in position and preventing unfolding of the panels.

A container constructed in accordance with the invention is very effective in containing bulk quantities of liquids, e.g., 250–300 gallons, and may be safely stacked as many as six high. The rolled reinforcing flanges at the top and bottom ends of the container resist bulging of the side walls due to pressure of liquid stored in the container, and also hold corner posts in position, when corner posts are used to increase stacking strength.

While particular embodiments of the invention have been illustrated and described in detail herein, it should be understood that various changes and modifications may be made to the invention without departing from the spirit and intent of the invention as defined by the scope of the appended claims.

What is claimed is:

1. A container with an integral reinforcing flange to resist bulging of the container side walls under the pressure of the contents of the container, comprising:

opposed side walls having upper and lower ends and joined along adjacent longitudinal sides to form an open-ended enclosure;

at least one of the upper and lower ends having a flange on each of the side walls, said flanges having a tubular cross-sectional configuration and extending across the width of the respective side walls into abutting, interlocking relationship with one another at adjoining ends;

said flanges each having a plurality of foldably connected panels, including a first panel joined to an adjacent edge of a respective side wall and folded to lie substantially coplanar with the end of the container, and a second panel extending inwardly of the container from an inner marginal edge of the first panel; and at least one of the panels in each flange having projections and recesses formed in its opposite ends, the projections on the end of a panel in one flange engaging in the recesses in the adjacent end of a panel in an adjacent flange, whereby adjacent ends of adjacent flanges have interfitting projections and recesses to hold the flanges in their erected condition.

2. A container as claimed in claim 1, wherein:

the first panel on one flange has a tab on at least one end that overlies the adjacent end of the first panel on an adjacent flange, and the second panel in said one flange has a shoulder on said at least one end that abuts against the second panel in said adjacent flange, said tab and shoulder serving to hold the first and second panels in their folded positions.

3. A container as claimed in claim 2, wherein:

the second panel in said adjacent flange has a cutout in an end adjoining said one flange; and a third panel is connected with the second panel and lies against the adjacent side wall, said third panel having a flap that extends into said cutout, and in cooperation with abutment of the shoulder against the second panel of said adjacent flange, retains the panels of said one flange in erected condition.

4. A container as claimed in claim 3, wherein:

the flanges have a triangular cross-sectional configuration;

the third panel of said one flange extends behind the flange parallel to and contiguous with the adjacent side wall; and the third panel of said adjacent flange extends away from the flange parallel to and contiguous with the adjacent side wall.

5. A container as claimed in claim 4, wherein:

there are two pairs of opposed side walls defining a rectangular enclosure; and the flanges on a first pair of opposed side walls are constructed identically to one another, and the flanges on a second pair of opposed side walls are constructed identically to one another but different from the flanges on the first pair.

6. A container as claimed in claim 1, wherein:

said panels in said flanges have cutouts in adjacent ends, defining openings through the flanges; and corner posts are received in the openings, extending from the top to the bottom of the container, to reinforce it for stacking of multiple containers on top of one another.

7. A container as claimed in claim 6, wherein:

there are flanges on both the top and bottom ends of the container; and said openings in the flanges on the top end of the container extend all the way through the flanges, and the openings in the flanges on the bottom end of the container extend only part way through the flanges, whereby corner posts can be inserted all the way through the flanges at the top of the container and supported on the flanges at the bottom of the container.

8. A container as claimed in claim 1, wherein:

there are flanges on at least the bottom end of the container;

said second panel of said flanges extends angularly upwardly and outwardly from an inner marginal edge of the first panel to define a sloping annular support surface; and a tray insert having an upwardly and outwardly sloping marginal edge complementary to the support surface is inserted into the container with its marginal edge resting on the support surface to form a bottom wall in the container.

9. A container as claimed in claim 8, wherein:

the first panel on one flange has a tab on at least one end that overlies the adjacent end of the first panel on an adjacent flange, and the second panel in said one flange has a shoulder on said at least one end that abuts against the second panel in said adjacent flange, said tab and shoulder serving to hold the first and second panels in their folded positions.

10. A container as claimed in claim 9, wherein:

the second panel in said adjacent flange has a cutout in an end adjoining said one flange; and a third panel is connected with the second panel and lies against the adjacent side wall said third panel having a flap that extends into said cutout, and in cooperation with abutment of the shoulder against the second panel of said adjacent flange, retains the panels of said one flange in erected condition.

11. A container as claimed in claim 10, wherein:

the flanges have a triangular cross-sectional configuration;

the third panel of said one flange extends behind the flange parallel to and contiguous with the adjacent side wall; and the third panel of said adjacent flange extends away from the flange parallel to and contiguous with the adjacent side wall.

12. A container as claimed in claim 11, wherein:

there are two pairs of opposed side walls defining a rectangular enclosure; and the flanges on a first pair of opposed side walls are constructed identically to one another, and the flanges on a second pair of opposed side walls are constructed identically to one another but different from the flanges on the first pair.

13. A container as claimed in claim 7, wherein:

the first panel on one flange has a tab on at least one end that overlies the adjacent end of the first panel on an adjacent flange, and the second panel in said one flange has a shoulder on said at least one end that abuts against the second panel in said adjacent flange, said tab and shoulder serving to hold the first and second panels in their folded positions.

14. A container as claimed in claim 13, wherein:

the second panel in said adjacent flange has a cutout in an end adjoining said one flange; and the third panel in said one flange has a flap that extends into said cutout, and in cooperation with abutment of the shoulder against the second panel of said adjacent flange, retains the panels of said one flange in erected condition.

15. A container as claimed in claim 14, wherein:

the flanges have a triangular cross-sectional configuration;

the third panel of said one flange extends behind the flange parallel to and contiguous with the adjacent side wall; and the third panel of said adjacent flange extends away from the flange parallel to and contiguous with the adjacent side wall.

16. A container as claimed in claim 15, wherein:

there are two pairs of opposed side walls defining a rectangular enclosure; and the flanges on a first pair of opposed side walls are constructed identically to one another, and the flanges on a second pair of opposed side walls are constructed identically to one another but different from the flanges on the first pair.

17. A container, comprising:

upright side walls defining an open-ended tubular enclosure having top and bottom ends;

a reinforcing flange on at least the bottom end, defining a peripheral, downwardly and inwardly sloping support surface surrounding the open bottom end; and a closure panel having an upwardly and outwardly sloping marginal edge complementary to the downwardly and inwardly sloping support surface, said closure panel resting at its marginal edge on the support surface to close the bottom of the container.

18. A container for storage and shipment of bulk materials, comprising:

a plurality of side walls having upper and lower ends and forming an open-ended tubular enclosure;

a reinforcing flange on the upper and lower ends of each of the side walls, said reinforcing flanges having a tubular transverse cross-sectional configuration and having interlocking means at adjacent ends thereof to retain the flanges in erected condition; and corner posts inserted through the flanges at the upper end of the side walls and into the flanges at the lower end, said flanges having means to retain the corner posts in position.

19. A container as claimed in claim 18, wherein:

the corner posts have interengaging means so that the corner posts assist in maintaining the flanges in their erected condition.

* * * * *